US006311703B1

(12) United States Patent
Webster et al.

(10) Patent No.: US 6,311,703 B1
(45) Date of Patent: Nov. 6, 2001

(54) SCARF FLUSHING APPARATUS

(75) Inventors: Keith B. Webster; Richard L. Shafer, both of East Palestine, OH (US)

(73) Assignee: Buckeye Manufacturing, Inc., East Palestine, OH (US)

( * ) Notice: Subject to any disclaimer, the term of this patent is extended or adjusted under 35 U.S.C. 154(b) by 0 days.

(21) Appl. No.: 09/439,898

(22) Filed: Nov. 12, 1999

(51) Int. Cl.[7] ..... B08B 9/032

(52) U.S. Cl. ..... 134/22.12; 134/104.2; 134/113; 134/133; 134/169 C

(58) Field of Search ..... 134/166 C, 167 C, 134/168 C, 169 C, 22.12, 104.2, 113, 133, 152

(56) References Cited

U.S. PATENT DOCUMENTS 1,984,771 12/1934 Speller .
2,189,339 2/1940 Black et al. .
3,765,050 10/1973 Van Allman et al. .
3,850,692 11/1974 Van Allman et al. .
4,863,555 9/1989 John, Jr. et al. .
5,680,877 * 10/1997 Edstrand et al. ..... 134/169 C X
6,035,870 * 3/2000 Monch ..... 134/169 C X

* cited by examiner

*Primary Examiner*—Philip R. Coe
(74) *Attorney, Agent, or Firm*—Robert J. Herberger

(57) ABSTRACT

A scarf flushing apparatus for cleaning the inside of tubes. The apparatus comprises a continuous and uninterrupted fluid flow system. The system comprises a transfer mechanism communicating with a flow control mechanism to direct flow through a nozzle to clean each tube being indexed therethrough and to redirect flow through a bypass line and into a reservoir during the indexing sequence. A pressure gauge and regulating valve communicate with the continuous fluid flow system so as to maintain substantially constant pressure throughout the fluid flow system during the cycling process.

12 Claims, 5 Drawing Sheets

SCARF FLUSHING APPARATUS

FIELD OF THE INVENTION

This invention relates to a scarf flushing apparatus used to clean debris from the inside of tubular products, such as metal tubes and pipes. More specifically, this invention can be used to remove scarf and other debris from the inside of metal tubes and pipes after welding the longitudinal seam of the tube during fabrication thereof.

BACKGROUND OF THE INVENTION

In the art of making tubular metal products such as tubes and pipes (hereinafter tubes and pipes will be used interchangeably), one of the processes begins with a sheet or strip of metal. The metal is rolled in such a way to form a desired tube diameter. Then the longitudinal seam of the tube is welded closed. However, the welded seam does not produce a uniform tube wall thickness, and the tube may undergo a process to remove the excess metal from the weld. The debris that results from this removal, commonly referred to as "scarf," often remains in the interior of the tubular product and is undesirable to the consumer for various safety and quality control reasons.

Various operations are available to remove the scarf and debris from the inside of tubes. Generally, pressurized water is forced through the tube to remove the scarf. However, in order for the water to properly flush the tube, a pump is needed to generate a high velocity fluid flow. Pumps and valves used in these operations often experience undue wear caused by differentiating pressures in the system and the "on" and "off" cycling of the pump as the flushing operation is repeated as a plurality of tubes are sequentially advanced through the operation. Of course, cycling the pump "on" and "off" repeatedly lessens the pump's performance and life and causes an effect known as water hammering. Water hammering will result when fluid flow is abruptly stopped, for instance, by a closed valve. The energy in the fluid has no where to go and, therefore, reverberates throughout the system. The energy can damage valves and pumps in fluid flow operations to such an extent that replacement is often required.

The preferred flushing system would operate so that the pump runs continuously and is not subject to intermittent activity. The desired flushing apparatus would also have pressure regulation so that the pressure in the system would be substantially equal throughout the flushing operation and cycling thereof.

Art in the field is directed to processes and apparatuses used in removing scarf and other unwanted materials from the inside of tubular products. However, there is nothing in the art directed to optimizing pump utilization and eliminating water hammering by maintaining continuous fluid flow at substantially constant pressure throughout the system, despite repeated flushing cycles, as with the instant invention. As a result, this invention prolongs the life of a scarf flushing apparatus by eliminating water hammering.

SUMMARY OF THE INVENTION

The present invention is directed to an apparatus for removing scarf and debris from the inside of tubes, satisfying the need to minimize waste of the working fluid, maintaining the life of the working pump and eliminating water hammering. This is accomplished through continual flow of the working fluid through the apparatus by diverting the flow to a bypass line when a tube is being indexed in and out of the flushing operation, and by maintaining substantially constant pressures throughout the fluid flow system thereof.

This invention comprises a frame affixed to a base and a fluid flow system attached to the frame. The fluid flow system has a fluid control mechanism. The working fluid is continuously circulated throughout the fluid flow system by the flow control mechanism. The invention further comprises a reservoir to contain the working fluid. The reservoir has a catching enclosure or drain system to collect the working fluid after it passes through the tube being flushed. The working fluid can be a mill coolant or any other fluid suitable for flushing tubes.

The working fluid is pumped out of the reservoir to a spray nozzle. The working fluid is then dispensed through the nozzle and in and through the unclean tube positioned in front of the nozzle. The tube is positioned in front of the nozzle by a tube transfer mechanism. The working fluid enters the tube at a proper volume, velocity and spray pattern to clean any scarf, oil or other debris. To vary the volume, velocity and spray pattern of the working fluid for different lengths and diameters of tubes, the nozzle is interchangeable. The working fluid, along with the debris, exits the tube at its distal end and enters the reservoir for recycling thereof.

Once a tube is flushed, it leaves the transfer station and a new tube is indexed into position. During this sequence, the tube transfer mechanism, communicating with a flow control mechanism, operates to close the output valve to the nozzle and diverts the working fluid to a bypass line which re-directs the working fluid directly back into the reservoir. When the next tube is indexed properly in front of the spray nozzle, the flow control mechanism is activated, closing the bypass valve and opening the output valve to once again pass the working fluid through the nozzle and into the newly positioned tube. The function of the flow control mechanism is such that the pump will be cycling working fluid through the system continuously, thus eliminating water hammering and maintaining the pump's life and performance without wasting fluid.

To maintain a relatively constant pressure in the fluid flow system, a pressure gauge communicates with the outlet side of the pump. Further, a regulating valve is located on the bypass side of the flow system. Once the system is operating, the regulating valve is adjusted so that the pressure is substantially equal on the bypass line and output line of the flow system. By maintaining substantially equal pressure therein, water hammering and unnecessary wear and tear on the pump is eliminated.

Accordingly, it is an object of the present invention to provide a scarf flushing apparatus that is capable of flushing pipe or other tubular products while maintaining continuous flow throughout the system to eliminate water hammering using a flow control mechanism to divert fluid flow back to a reservoir when the tubular product is not positioned properly in front of the spray nozzle at the transfer station.

Another objective of the present invention is to provide a scarf flushing apparatus that allows pressure regulation throughout the system so as to eliminate water hammering and prolong the life and performance of a pump.

Still another objective of the present invention is to provide a scarf flushing apparatus that recycles and reuses the working fluid without unnecessary and unwanted waste.

These and other features, aspects and advantages of the present invention will become better understood with reference to the following description and appended claims.

BRIEF DESCRIPTION OF THE DRAWINGS

The figures listed below have been selected to illustrate a preferred embodiment of the present invention. These figures along with the accompanying description are sufficient for those skilled in the art to practice the invention as claimed. Included are:

PREFERRED EMBODIMENT

Figure 1:
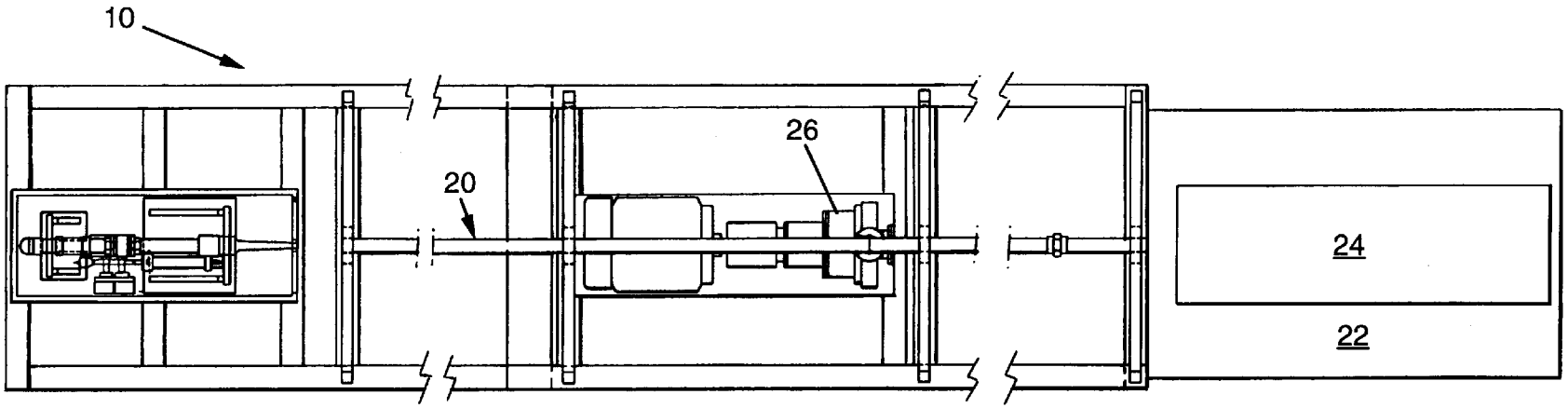
FIG. 1 is a top plan view of the apparatus of the present invention.
Figure 2:
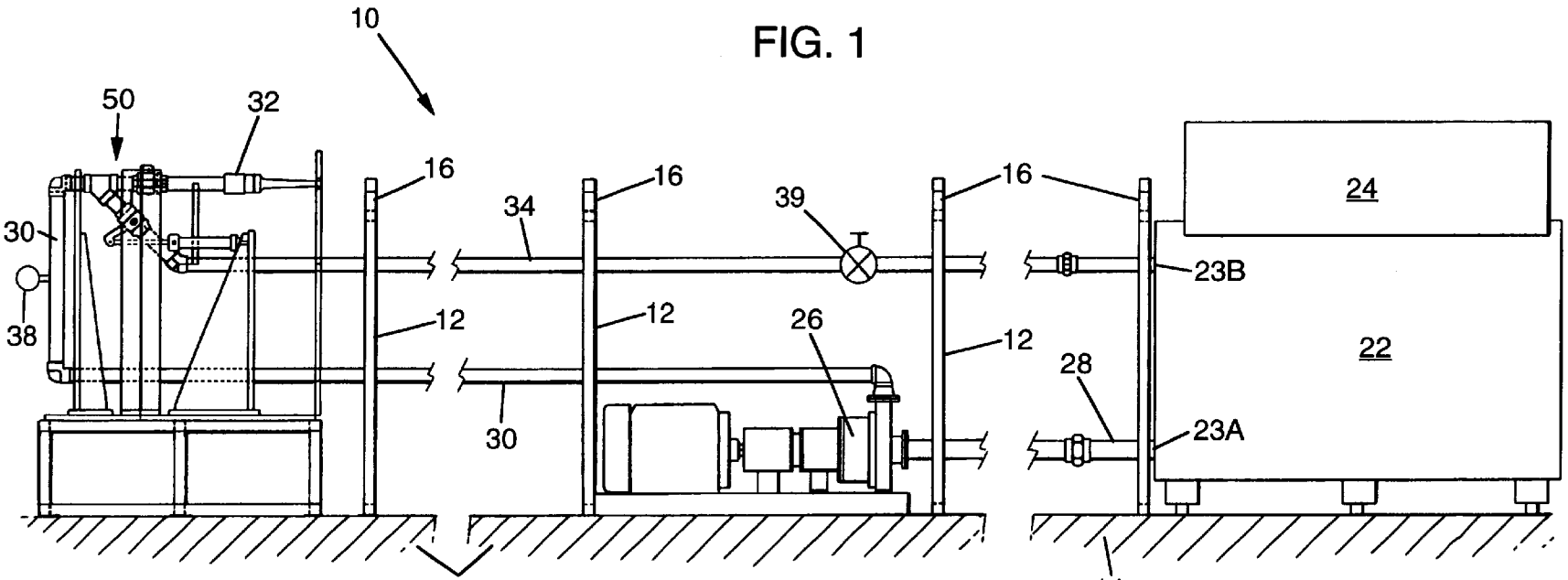
FIG. 2 is an elevational view of the apparatus of FIG. 1.

Viewing FIGS. 1 and 2, a scarf flushing apparatus 10 comprises a fluid flow system 20 having a reservoir 22 with an output opening 23A and an input opening 23B for passing of a working fluid. The invention also comprises a pump 26 having an input line 28 and an output line 30, the pump input line 28 being connected to the reservoir 22 at the reservoir output opening 23A. The pump output line 30 is connected to a flow control mechanism 50 that controls the flow of the working fluid to a spray nozzle 32 and a bypass line 34 alternately with substantially continuous fluid flow.

Further, the scarf flushing apparatus 10 comprises a pressure sensor or gauge 38 for measuring the pressure in the output line 30 and a regulating valve 39 for regulating the flow rate in the bypass line 34 so that the fluid pressure in the bypass line 34 is maintained substantially equal to the pressure through the spray nozzle 32. Tubes are indexed and positioned in and out of the apparatus 10 by a tube transfer station 16 having a transfer mechanism 79 as discussed in more detail below.

Figure 3A:
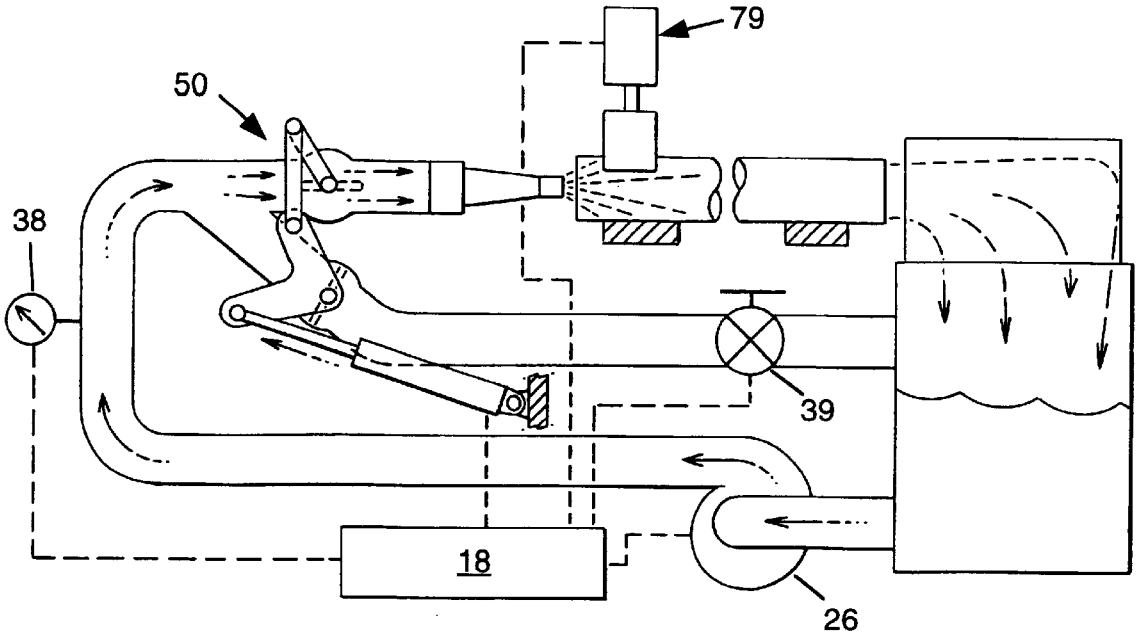
FIGS. 3A and 3B are schematic drawings showing the control of flow through the apparatus.
Figure 3B:
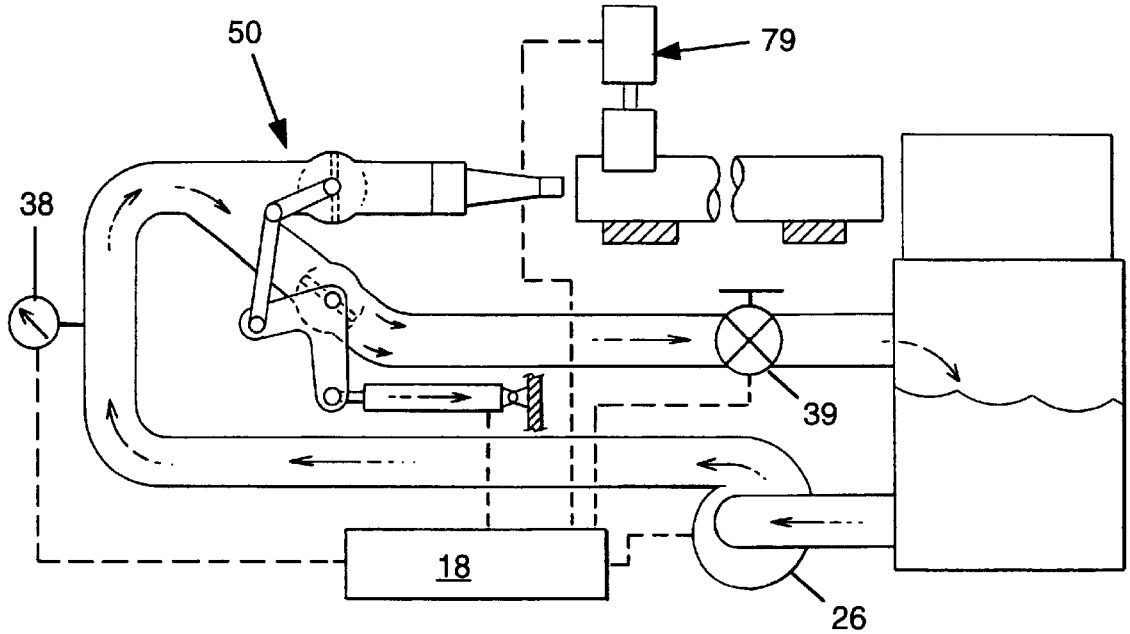

The pump 26, flow control mechanism 50, transfer mechanism 79, pressure sensor 38 and regulating valve 39 are controlled by a control mechanism 18 as schematically shown in FIGS. 3A and 3B. The control mechanism 18 for operating these components of the apparatus 10 can be manual, mechanical, electric, pneumatic or hydraulic power, or any combination thereof as is well known in the art.

Continuing to view FIGS. 1 and 2, the scarf flushing apparatus 10 includes a base 14 supporting a frame 12 for the fluid flow system 20. The frame includes the tube transfer station 16 for indexing and positioning tubing in and out of the apparatus 10. The reservoir 22 contains working fluid, and a fluid catching enclosure 24 is attached to the top of the reservoir 22 for catching working fluid that is expelled from the spray nozzle 32. The working fluid can be mill coolant or a cleaning liquid, but it is not limited thereto, and the catching enclosure 24 can be a drain to collect the working fluid into the reservoir 22 if the reservoir is located below the ground. Also, the reservoir 22 can be any source for working fluid.

Figure 4A:
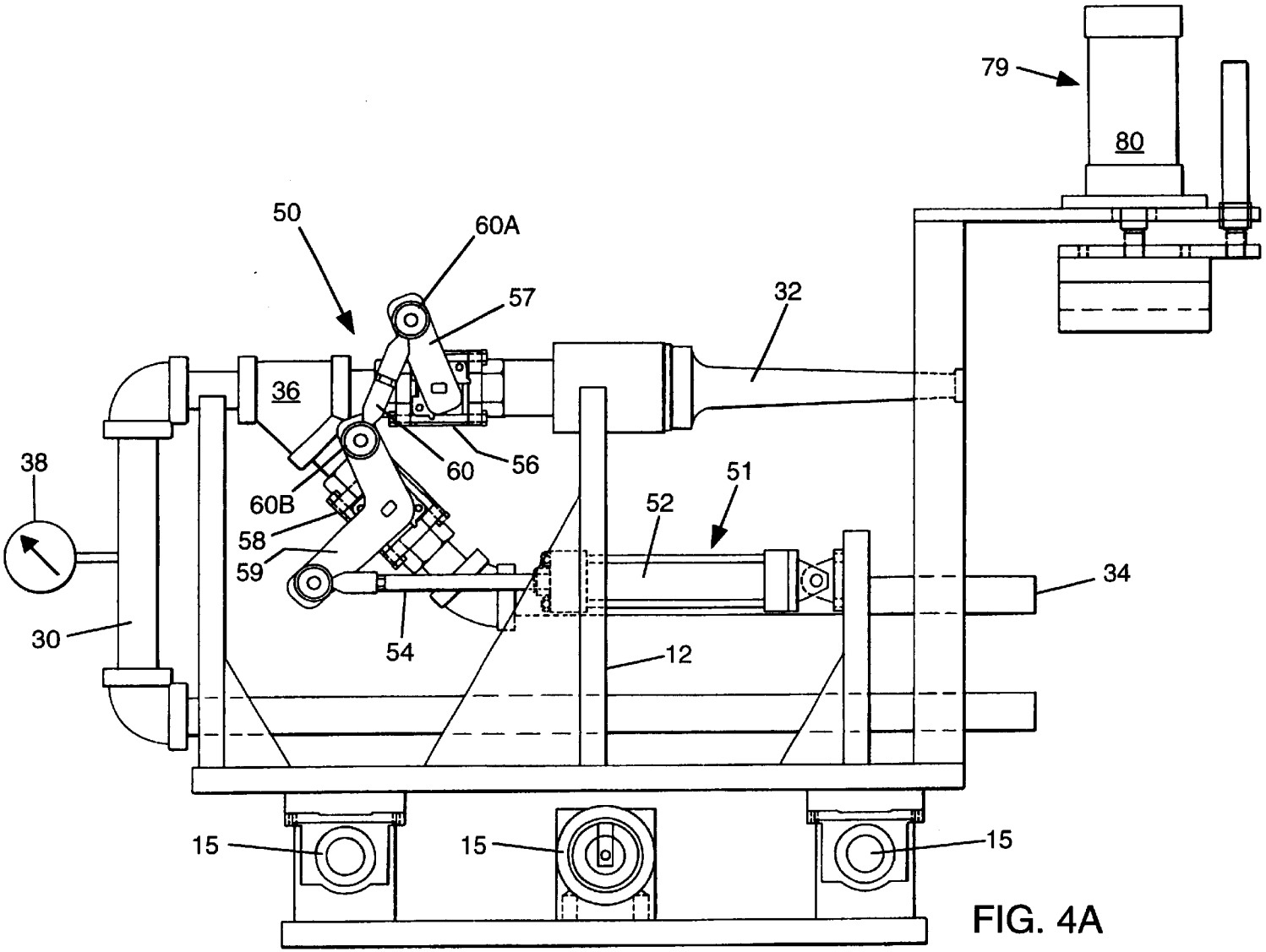
FIG. 4A is an enlarged elevational view of FIG. 2 illustrating the flow control mechanism of the apparatus as the working fluid flows through the output side of the system.
Figure 4B:
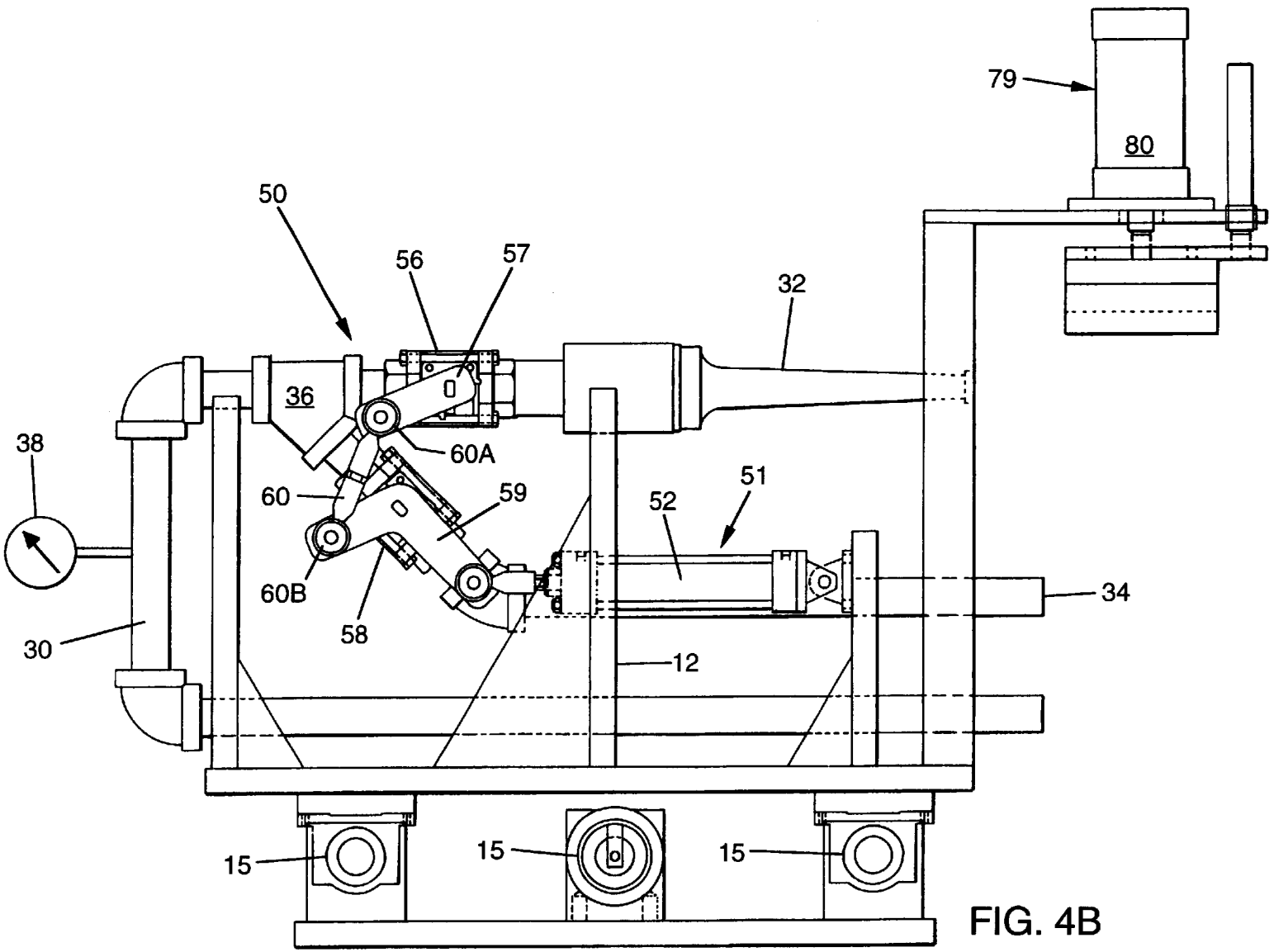
FIG. 4B is an enlarged elevational view of FIG. 2 illustrating the flow control mechanism of the apparatus as the working fluid flows through the bypass side of the system.

As best seen in FIGS. 4A and 4B, the flow control mechanism 50 further comprises a connecting joint 36 which splits the output line 30 into two streams. The output line 30 either carries the working fluid to the attached spray nozzle 32, or it is diverted through the bypass line 34 which connects directly back to the reservoir 22. The pressure sensor 38 is attached on the output line 30, and the regulating valve 39 is affixed to the bypass line 34. The spray nozzle 32 is connected to the output line 30 so that the nozzle 32 can be interchangeable to accommodate various lengths and diameters of the tubing being cleaned. Also, the frame 12 of the scarf-flushing apparatus 10 includes an adjustment device 15 that properly positions the spray nozzle 32 horizontally relative to various tube diameters.

The flow control mechanism 50 further comprises an actuator 51, an output valve 56, an output actuating arm 57, a bypass valve 58 and a bypass actuating arm 59 as best seen in FIGS. 4A and 4B. The actuator 51 further comprises an actuating cylinder 52 and a piston 54. A pivotal connecting arm 60 attaches between the output actuating arm 57 and the bypass actuating arm 59 through the pivot points 60A, 60B. The output actuating arm 57 and the bypass actuating arm 59 communicate with the output valve 56 and bypass valve 58, respectfully, so that rotation of the output actuating arm 57 opens and closes the output valve 56, while the rotation of the bypass actuating arm 59 closes and opens the bypass valve 58. Although this is the preferred flow control mechanism, other types of valves may provide the proper flow diversion, such as a multi-path output valve that can be operated mechanically, electrically or pneumatically.

Continuing to refer to FIGS. 4A and 4B, the actuator 51 is affixed to the frame 12 and has the actuating cylinder 52 and the piston 54. The actuator 51 can be controlled by either air or hydraulics, but it is not limited to these variations. When charged, the actuating cylinder 52 forces the piston 54 to extend outward. As the piston 54 is forced outward, it rotates the bypass actuating arm 59 attached thereto. The bypass actuating arm 59 exerts force on and rotates the pivotal connecting arm 60, which in turn exerts force on the output actuating arm 57 and rotates it. Accordingly, the flow control mechanism 50 operates so that when the output valve 56 is open, the bypass valve 58 is closed. Also, when the output valve 56 is closed, the bypass valve 58 is open.

Tubes being indexed through the tube transfer station 16 are gravity fed, walking beam transferred or positioned by any other suitable mechanism. As previously stated, the tube transfer station 16 includes the transfer mechanism 79, which has a tube clamping mechanism 80. The transfer mechanism 79 communicates with the actuator 51 of the flow control mechanism 50 as tubes are individually indexed, positioned and clamped in line with the spray nozzle 32. Fluid flow is directed to either the spray nozzle 32 when a tube is properly positioned and clamped at the spray nozzle 32 or to the bypass line 34 when the tube is unclamped and exiting therefrom or just entering therein.

In summary, the scarf removing apparatus for tubing 10 operates in such a way that the working fluid is continuously circulated through the fluid flow system 20 by the pump 26. The pump 26 pulls fluid from the reservoir 22 via the input line 28. The working fluid then passes through the pump 26 to the output line 30. Where the working fluid flows next is dependent upon the position of tubes at the tube transfer station 16. Continuing to view FIGS. 3A, 3B, 4A, 4B and 5, if a tube 11B is positioned at the tube transfer station 16 in line with the spray nozzle 32, the transfer mechanism 79 communicates with the actuator 51, causing the actuating cylinder 52 to force the piston 54 to activate outward. Upon activation, the piston 54 rotates the bypass actuating arm 59, which in turn rotates the output actuating arm 57, via the pivotal connecting arm 60, such that the bypass valve 58 is closed and the output valve 56 is opened simultaneously. The working fluid then passes through the connecting joint 36 exiting through the spray nozzle 32 and through the tube positioned in line therewith so that scarf or any other debris is removed therefrom. The working fluid then exits the tube and is captured in the fluid catching enclosure 24 and filtered by a screen 21 for re-circulation.

Figure 5:
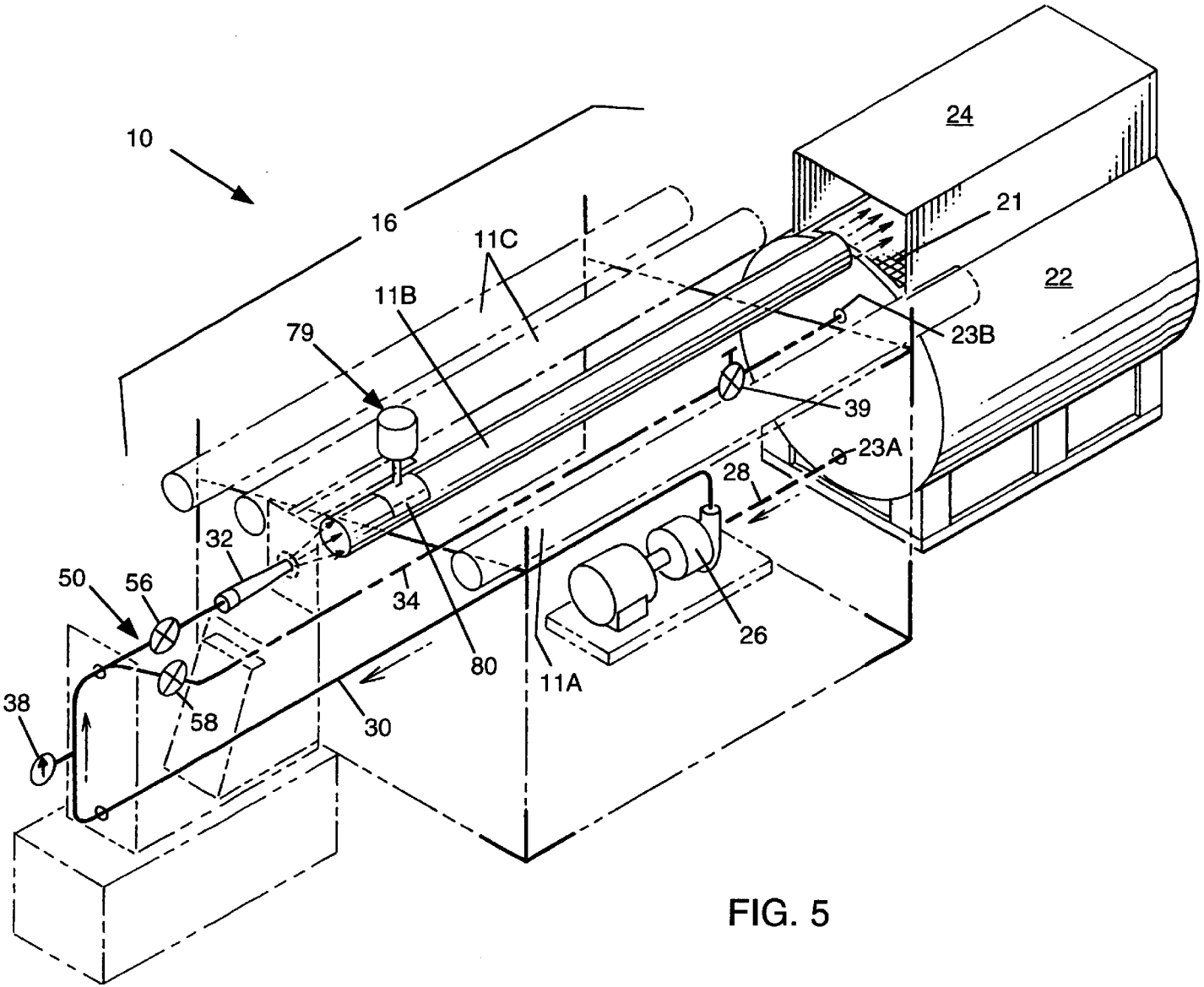
FIG. 5 is a perspective schematic view of the apparatus showing tubes being indexed and positioned by a transfer station.

As shown in FIG. 5, after scarf and debris are removed from the tube, the transfer mechanism 79 releases the clean tube 11B, 11C and allows the next unprocessed tube 11A to take position in line with the spray nozzle 32. The time the tubes stay at the spray nozzle position can be programmed automatically or performed manually. While the tubes are being indexed in and out of position 11A, 11B, 11C, the transfer mechanism 79 communicates with the actuator 51 to close the output valve 56 as shown in FIGS. 3B and 4B. More specifically, the actuator 51 causes the actuating cylinder 52 to retract the piston 54, causing the bypass actuating arm 59 to rotate in the opposite direction. In turn, the bypass actuating arm 59 rotates via the pivotal connecting arm 60, which in turn rotates the output actuating arm 57 resulting in the output valve 56 closing and the bypass valve 58 opening simultaneously. The working fluid is then diverted through the bypass line 34 and into the reservoir 22 where it is re-circulated without significant waste. The process then repeats itself.

Finally, during operation, uniform regulation of the fluid flow pressure is desirable to eliminate water hammering which prolongs the life and performance of the pump 26. If unchecked and unregulated, the fluid pressure in the fluid flow system could drastically change as the output valve 56 and bypass valve 58 are cycled open and closed. This has a detrimental effect on the valves 56, 58 and pump 26 as discussed above. In the instant invention, the pressure sensor 38 measures the pressure in the output line 30 which may vary between various interchangeable spray nozzles 32. After determining the output line pressure, the pressure in the bypass line 34 is adjusted through the regulating valve 39 so that the bypass line 34 pressure is substantially equal to the output line 30 pressure as fluid passes through the selected spray nozzle 32. Pressure regulation can be performed manually or automatically through the control mechanism 18 as discussed above.

The previously described version of the present invention has many advantages, including the elimination of water hammering and the prolonged life and performance of the pump 26. This is accomplished through the continuous flow of the working fluid through the fluid flow system 20 by the flow control mechanism 50. It is also accomplished through the regulation of the pressure in the fluid flow system 20 as previously described. Although the present invention has been described in considerable detail with reference to certain preferred versions thereof, other versions are possible. Therefore, the spirit and scope of the appended claims should not be limited to the description of the preferred versions contained herein.

What is claimed is:

1. A scarf flushing apparatus for tubing, comprising:

a fluid flow system having a reservoir with a reservoir input and a reservoir output for passing of a working fluid;

a pump having an input and an output, the pump input being connected to said reservoir at the reservoir output, the pump output being connected to a flow control mechanism that controls the flow of the working fluid to a spray nozzle and a bypass line alternately with substantially continuous fluid flow; and a transfer mechanism for sequencing said tubing in line with the spray nozzle such that said working fluid can flow from the spray nozzle, through each positioned tube, and exit said positioned tube before flowing to the reservoir.

2. The apparatus of claim 1, wherein the reservoir further comprises a fluid catching enclosure for catching working fluid expelled from the spray nozzle.

3. The apparatus of claim 1, wherein the flow control mechanism further comprises an output valve that controls the flow of working fluid to the spray nozzle and a bypass valve that controls the flow of working fluid to the bypass line.

4. The apparatus of claim 3, wherein the flow control mechanism further comprises an actuator, said actuator having a cylinder and a piston, the bypass valve being pivotally connected to the piston, and the output valve communicating with the bypass valve such that the actuator causes the bypass valve to open and the output valve to close substantially simultaneously.

5. The apparatus of claim 4, wherein the actuator is pneumatic.

6. The apparatus of claim 4, wherein the actuator is hydraulic.

7. The apparatus of claim 1, wherein said transfer mechanism sequentially transfers the tubing by gravity.

8. A scarf flushing apparatus for tubing, comprising:

a fluid flow system having a reservoir with an input opening and an output opening for passing of a working fluid;

a pump having an input and an output, the pump input being connected to said reservoir at the reservoir output opening, the pump output being connected to a flow control mechanism that controls the flow of the working fluid to a spray nozzle and a bypass line alternately with substantially continuous fluid flow;

a sensor for measuring the pressure in the fluid flow;

a valve for regulating the pressure in the bypass line so that the pressure through the bypass line may be maintained substantially equal to the pressure through the nozzle; and a transfer mechanism for positioning said tubing in line with the spray nozzle.

9. The apparatus of claim 8, wherein the reservoir further comprises a fluid catching enclosure for catching working fluid expelled from the spray nozzle.

10. The apparatus of claim 8, wherein the flow control mechanism further comprises an output valve that controls the flow of working fluid to the spray nozzle and a bypass valve that controls the flow of working fluid to the bypass line.

11. The apparatus of claim 10, wherein the flow control mechanism further comprises an actuator, said actuator having a cylinder and a piston, the bypass valve being pivotally connected to the piston, and the output valve communicating with the bypass valve such that the actuator causes the bypass valve to open and the output valve to close substantially simultaneously.

12. A method for flushing scarf from a tube, comprising the steps of:

circulating a working fluid through a fluid flow system;

feeding a tube into position in line with a spray nozzle in the fluid flow system;

actuating a flow control mechanism to allow fluid flow through the spray nozzle and into and through said tube in position with said spray nozzle;

capturing the working fluid exiting said tube in a fluid catching enclosure communicating with a reservoir for the recycling of the working fluid;

transferring said flushed tube out of the aligned position while simultaneously actuating the flow control mechanism to redirect fluid flow from the spray nozzle to a bypass line in the fluid flow system and into said reservoir; and maintaining the pressure in the fluid flow system substantially constant using a regulating valve on the bypass line.

* * * * *